US006745835B2

(12) United States Patent
Fields

(10) Patent No.: US 6,745,835 B2
(45) Date of Patent: Jun. 8, 2004

(54) METHOD AND APPARATUS FOR PRESSURE CONTROLLED DOWNHOLE SAMPLING

(75) Inventor: Troy Fields, Stafford, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/064,635

(22) Filed: Aug. 1, 2002

(65) Prior Publication Data

US 2004/0020649 A1 Feb. 5, 2004

(51) Int. Cl.[7] ..... E21B 49/08

(52) U.S. Cl. ..... 166/264; 166/100; 166/167; 175/58; 175/59; 73/152.23; 73/152.24; 73/152.26

(58) Field of Search ..... 166/264, 167, 166/100; 175/40, 58–59; 73/152.55, 152.28, 152.23, 152.24, 152.26

(56) References Cited

U.S. PATENT DOCUMENTS

| | | | | |
|---|---|---|---|---|
| 3,273,647 | A | * 9/1966 | Briggs, Jr. et al. | 166/100 |
| 3,969,937 | A | 7/1976 | Barrington et al. | |
| 4,703,799 | A | 11/1987 | Jennings, Jr. et al. | |
| 4,745,802 | A | 5/1988 | Purfurst | |
| 4,860,581 | A | 8/1989 | Zimmerman et al. | |
| 4,936,139 | A | 6/1990 | Zimmerman et al. | |
| 4,994,671 | A | 2/1991 | Safinya et al. | |
| 5,056,595 | A | 10/1991 | Desbrandes | |
| 5,166,747 | A | 11/1992 | Schroeder et al. | |
| 5,249,461 | A | * 10/1993 | Ponder et al. | 73/152.18 |
| 5,303,775 | A | 4/1994 | Michaels et al. | |
| 5,335,730 | A | * 8/1994 | Cotham, III | 166/374 |
| 5,337,822 | A | 8/1994 | Massie et al. | |
| 5,377,755 | A | 1/1995 | Michaels et al. | |
| 5,644,076 | A | 7/1997 | Proett et al. | |
| 5,692,565 | A | * 12/1997 | MacDougall et al. | 166/264 |
| 5,741,962 | A | * 4/1998 | Birchak et al. | 73/152.16 |
| 5,890,549 | A | 4/1999 | Sprehe | |
| 5,934,374 | A | 8/1999 | Hrametz et al. | |
| 5,939,717 | A | 8/1999 | Mullins | |
| 5,956,132 | A | 9/1999 | Donzier | |
| 6,216,804 | B1 | 4/2001 | Aumann et al. | |
| 6,328,103 | B1 | 12/2001 | Pahmiyer et al. | |
| 6,378,631 | B1 | 4/2002 | Aumann et al. | |
| 6,467,544 | B1 | * 10/2002 | Brown et al. | 166/264 |
| 6,491,104 | B1 | * 12/2002 | Wilie et al. | 166/336 |
| 2002/0134587 | A1 | * 9/2002 | Rester et al. | 175/48 |

FOREIGN PATENT DOCUMENTS

| | | |
|---|---|---|
| EP | 0 791 723 A1 | 8/1997 |

* cited by examiner

*Primary Examiner*—David Bagnell
*Assistant Examiner*—Giovan Collins
(74) *Attorney, Agent, or Firm*—J.L. Jennie Salazar; Brigitte L. Jeffery; John Ryberg

(57) ABSTRACT

A method for sampling a subsurface formation includes positioning a formation testing tool in a borehole having borehole fluid with a pressure less than formation pressure such that a pressure differential exists between the borehole and the formation. The method also includes establishing fluid communication between the tool and the formation, and inducing flow from the formation into the tool by exposing the tool to the pressure differential. The method further includes capturing a formation fluid sample in a sample tank by directing formation fluid to the sample tank and exposing the sample tank to the pressure differential. A system for sampling a subsurface formation includes a formation testing tool having a probe assembly, a sample tank, and a conduit system. The system also includes wellhead for controlling borehole pressure. The wellhead includes a sealing apparatus, a pressure increasing device, and a flow adjustment device.

57 Claims, 8 Drawing Sheets

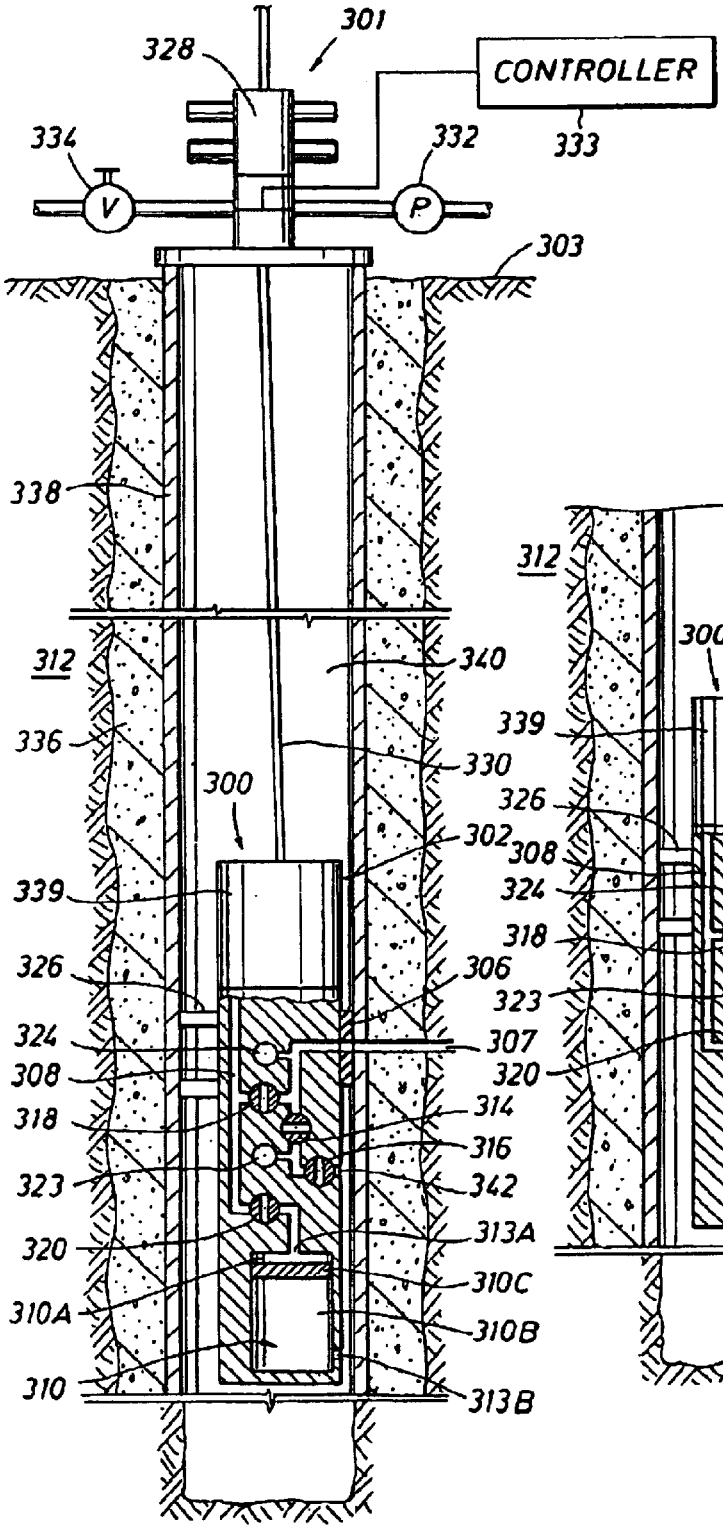
FIG. 2
FIG. 3A
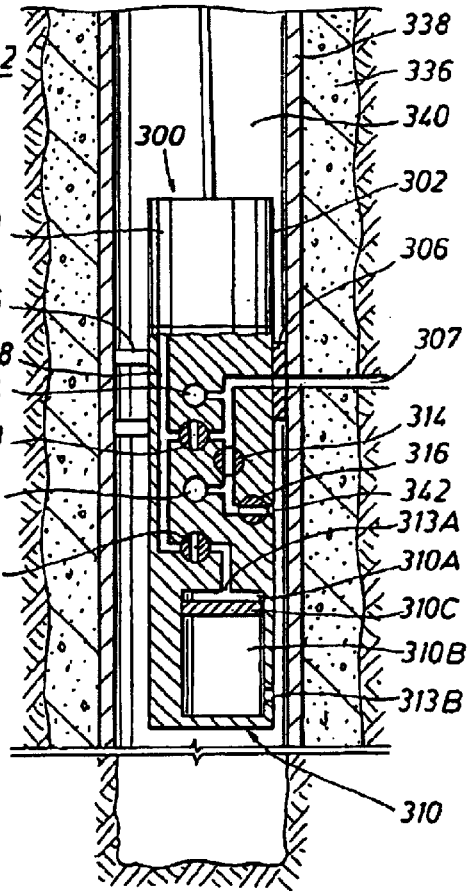

METHOD AND APPARATUS FOR PRESSURE CONTROLLED DOWNHOLE SAMPLING

BACKGROUND OF INVENTION

The invention relates generally to formation fluid sampling. More particularly, the invention relates to a method and an apparatus for obtaining a fluid sample from a subsurface formation traversed by a borehole while controlling the flow rate and/or pressure.

Fluid samples from subsurface formations are typically collected from a reservoir for analysis at the surface, downhole or in specialized laboratories. Information obtained from analyzing formation fluid samples often plays a vital role in the planning and development of hydrocarbon reservoirs and in the assessment of a reservoir's capacity and performance.

FIG. 1 shows one example of a conventional formation testing tool 100 which may be used to obtain a sample or conduct tests in a subsurface formation. Sampling operations are typically conducted in "overbalanced" boreholes, wherein the hydrostatic pressure of the borehole fluid is greater than the formation pressure. Overbalancing typically prevents the formation fluid from breaking through the walls of the wellbore and causing either "blowouts" or undesired pressure at surface.

In a typical sampling operation, the formation testing tool 100 is lowered into an overbalanced borehole 109 on a wireline 111 and positioned adjacent the subsurface formation 103 to be sampled. The formation testing tool 100 makes physical contact with the inside surface of the borehole 109 by engaging a probe 104 of a probe assembly 102 with a wall 112 of the borehole 109. One or more stabilizer pads 115 also extend from the formation testing tool 100 to stabilize the formation testing tool 100 in the borehole 109.

As shown in FIG. 1, the formation testing tool 100 includes a pump module 105 which is used to induce fluid flow from the formation 103 into the formation testing tool 100. An analyzer module 106 may also be provided to analyze fluid obtained from the formation. A plurality of sample tanks (not shown) are also disposed in a sample tank module 118 of the formation testing tool 100 to enable the collection of formation fluid samples in the tool 100.

Contact between the probe 104 of the formation testing tool 100 and the borehole wall 112 enables pressure communication with the formation 103. A seal is disposed around the probe 104 to isolate the inner parts of the formation testing tool 100 from the borehole fluid. In openhole boreholes, mudcake is typically disposed on the borehole wall 112 to isolate the formation fluid from the borehole fluid. In cased boreholes, casing and cement are disposed in the borehole to isolate the formation fluid from the borehole fluid.

Once the formation testing tool 100 is positioned and set as described above, one or more formation fluid samples may be obtained from the formation 103. Fluid communication is established between the formation testing tool 100 and the subsurface formation 103 by contacting the probe 104 to the subsurface formation 103. Because the formation 103 is at a lower pressure than the borehole 109, and the formation testing tool 100 is in communication with the higher borehole pressure, formation fluid may then be drawn into the formation testing tool 100 by using a downhole pump module 105. A downhole pump is used to create a desired pressure differential between the formation testing tool 100 and the subsurface formation 103 to induce flow from the formation 103 into the formation testing tool 100.

Other prior art formation testing tools and sampling methods have been developed as described in detail in U.S. Pat. Nos. 4,860,581; 4,936,139 (both assigned to Schlumberger); U.S. Pat. No. 5,303,775 (assigned to Western Atlas); and U.S. Pat. No. 5,934,374 (assigned to Halliburton). The formation sampling methods and tools in these cases disclose formation sampling operations carried out by flowing fluid into the formation testing tool with a downhole pump that creates a desired pressure differential. U.S. Pat. No. 5,377,755, assigned to Western Atlas International is another example of a formation testing tool used for sampling. This patent describes a formation testing tool including a bi-directional pump adapted to control the pressure differential in sample tanks. Valves are disposed in flow lines between the pump and the sample tanks to allow for the selective communication of fluid therebetween.

The prior art downhole testers and sampling techniques utilize pumps to collect samples and maintain the samples in "single phase." In single phase sampling operations, the pressure drop experienced by the formation fluid must be minimized to avoid drawing the formation fluid sample at a pressure below its bubble point pressure or asphaltene precipitation point. This is achieved in prior art formation testing tools by providing flow control during sampling. The flow control is largely dependent on the operation of one or more downhole pumps. As formation fluid is drawn out of the formation, the pressure drop experienced by the formation fluid and the rate of flow are regulated by the speed of the pump.

In a sampling operation, the initial drawdown of formation fluid from the formation is often contaminated by mudcake, filtrate, or debris. Pumps are used to remove a sufficient amount of formation fluid before collecting a formation fluid sample to purge these contaminates from the fluid stream. This initial formation fluid removal operation is referred to as the clean-up phase. When a sampling operation includes a clean-up phase, flow control is provided downhole by initially running a downhole pump as fast as possible to reduce the clean-up period and then lowering the downhole pump speed to maintain the formation fluid sample in a single phase during collection or downhole analysis of the sample. If the speed required by the downhole pump is below a certain operating threshold, the pump motor may stall causing the pump to fail. Therefore, the operating range of the downhole pump must be optimally designed or selected prior to a sampling operation. If failure of the downhole pump occurs during an operation, either another pump is required or the tool must be pulled to the surface and the existing pump fixed or replaced before a single phase sample may be acquired.

To minimize or avoid problems associated with the use of downhole pumps during sampling operations, a method is desired which allows for a formation fluid sample to be obtained and that allows for control of the flow rate and/or pressure disturbance experienced by the formation fluid during sampling. A method is also desired which permits sampling in a wellbore which does not require the use of a downhole pump. It is further desired that such a method may provide a technique for obtaining single phase samples.

SUMMARY OF INVENTION

In one aspect, the present invention relates to a method for sampling a subsurface formation traversed by a borehole. In one embodiment, the method comprises positioning a formation testing tool in a borehole having borehole fluid therein with a pressure less than formation pressure such that a pressure differential exists between the formation and the borehole. The formation testing tool includes a sample chamber having a first side, a second side and a movable fluid separator disposed there between. The method further includes establishing fluid communication between the formation testing tool and the formation and inducing fluid flow from the formation to the formation testing tool by exposing an interior of the formation testing tool to the pressure differential. The method also includes capturing a sample of the formation fluid in a sample tank associated with the formation testing tool by exposing the sample tank to the pressure differential.

In another aspect, the present invention relates to a method for performing a controlled pretest on a subsurface formation traversed by a borehole. In one embodiment, the method comprises positioning a formation testing tool in a borehole having borehole fluid therein with a pressure less than formation pressure such that a pressure differential exists between the borehole and the formation. The formation testing tool includes a variable volume sample tank having a sample chamber, a buffer chamber, and a moveable fluid separator between the sample chamber and the buffer chamber. The method further comprises establishing fluid communication between the formation testing tool and the formation, and inducing fluid flow from the formation into the formation testing tool by exposing an interior of the formation testing tool to the pressure differential. The method also includes drawing a volume of formation fluid in the sample tank by directing the formation fluid to the sample chamber of the sample tank and exposing the buffer chamber of the sample tank to the borehole pressure. The method further includes holding the volume on the sample chamber of the sample tank constant to allow pressure in the sample tank to build-up to a pressure proximal the formation pressure.

In another aspect, the present invention relates to a system for pressure controlled downhole sampling a subsurface formation traversed by a borehole. In one embodiment, the system comprises a formation testing tool adapted for placement in the borehole and a wellhead. The wellhead is disposed about the borehole proximal the surface and is adapted to seal borehole fluid therein such that the borehole fluid is maintained at a desired pressure. The formation testing tool includes a probe assembly, a conduit system, and at least one sample tank. The probe assembly is adapted to establish fluid communication between the formation testing tool and the subsurface formation. At least one sample tank includes a sample chamber adapted to accept formation fluid therein, a buffer chamber in fluid communication with the borehole, and a moveable fluid separator disposed between the sample chamber and the buffer chamber to maintain a separation of fluid there between. The conduit system includes a first end in fluid communication with the probe assembly, a second end in fluid communication with the borehole, and a third end in fluid communication with the sample chamber of the sample tank. The wellhead includes a sealing apparatus disposed about the borehole and adapted to seal borehole fluid therein, at least one pressure increasing device disposed in fluid communication with the borehole and adapted to enable selective increase of pressure in the borehole, and at least one flow adjustment device adapted to enable adjustment of the flow of borehole fluid out of the borehole.

Advantages of one or more embodiments of the invention may include the ability to accurately control the pressure drop experienced by the formation fluid during sampling by manipulating surface pressure applied to the borehole at the surface. Advantageously, by controlling the pressure and/or flow rate of borehole fluid at the surface a single phase formation fluid sample may be obtained.

Other aspects and advantages of the invention will be apparent from the following description and the appended claims.

BRIEF DESCRIPTION OF DRAWINGS

FIG. 2 shows a partial cross sectional view of a formation testing tool and system in accordance with the present invention.

FIGS. 3A–3F, show examples of valve configurations for various phases of sampling for a formation testing tool similar to that shown in FIG. 2.

DETAILED DESCRIPTION

Figure 1:
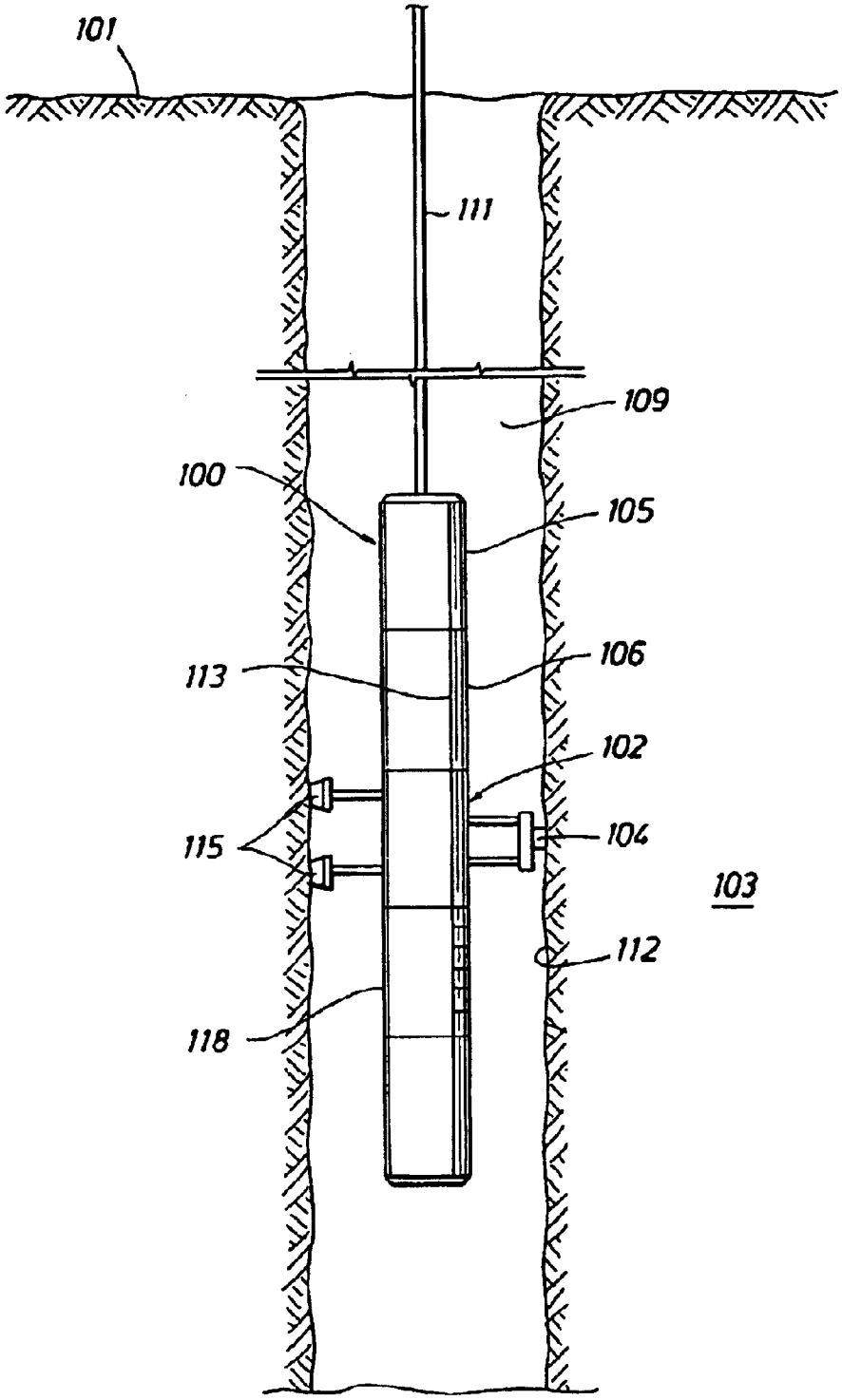
FIG.1 (PRIOR ART)
FIG. 1 shows a schematic view of a conventional formation testing tool positioned in a borehole adjacent a subsurface formation to be sampled.

The present invention provides a method and apparatus for sampling subsurface formations traversed by a borehole by controlling sampling pressures. In preferred embodiments, the method, advantageously, allows for manipulation of the borehole pressure after the formation pressure has been determined, which allows for control of the drawdown pressure and flow rate of formation fluid from the formation to the formation testing tool. In other embodiments, the method and apparatus may, advantageously, be used to obtain a single phase formation fluid sample from cased or openhole boreholes and/or provide for sampling without requiring a pump.

Exemplary embodiments of the present invention will now be described with reference to the accompanying figures.

FIG. 2 depicts a formation testing tool 300 and wellhead equipment 301 disposed about a borehole 340 having a casing 338 therein. The formation testing tool 300 is lowered into the cased borehole 340 on a work string 330. The borehole 340 is in an "underbalanced" condition, meaning that the borehole wherein the borehole fluid disposed therein has a pressure that is less than the pressure of the formation (s) 312 to be sampled. The work string 330 is used to convey the formation testing tool 300 into the borehole 340, and the wellhead equipment 301 is used to control and adjust the pressure of the borehole fluid in the borehole 340. Examples of work strings may include cable, drill pipe, coiled tubing, etc.

The wellhead equipment 301 includes a work string sealing apparatus 328, a pressure increasing device 332 (such as a pump) and a flow adjustment device 334 (such as a valve). The sealing apparatus 328 is positioned about the casing 338 to affect a pressure seal about the wellbore 340. The sealing apparatus 328 may comprise any type of equipment or device known in the art for shutting in a borehole at the surface and/or affecting a pressure seal on a borehole around a work string. An example of a wellhead device used to seal wellbores is disclosed in U.S. Pat. No. 4,718,487 assigned to Hydrolex Inc.

The wellhead equipment 301 also includes a pressure increasing device 332. The pressure increasing device 332 enables an increase of pressure on the borehole fluid in the borehole 340. In FIG. 2, the pressure increasing device 332 includes a pump (not shown) disposed proximal the surface 303 and arranged in fluid communication with the borehole 340. The wellhead equipment 301 may also include a controller (333) operationally coupled to the pressure increasing device 332.

In addition to sealing apparatus 328 and the pressure increasing device 332, the wellhead equipment 301 also includes a flow adjustment device 334. The flow adjustment device 334 enables adjustment of the flow of borehole fluid from the borehole 340 and/or the pressure on tho borehole fluid in the borehole 340. In FIG. 2, the flow adjustment device 334 is a flow valve, such as a metering valve or the like, which enables the adjustment of the flow of borehole fluid out of the borehole 340. The controller (333) may also be operationally coupled to the flow adjustment device 334. It will be realized by one of skill in the art that other combinations of valves and pumps are possible to achieve the same objective of controlling the pressure and/or flow of fluid to/from the borehole 340. For example, a pump that allows flow in the reverse direction could be used to reduce wellhead pressure.

In the formation testing tool 300, the probe assembly 306 comprises a probe capable of effecting sealing engagement on the inside surface of the borehole 340. As shown in FIG. 2, the tool 300 engages the casing 338 lining the borehole 340. The probe assembly 306 may be adapted to extend from the formation testing tool 300 and establish fluid communication between the formation testing tool 300 and the formation 312.

As shown in FIG. 2, the conduit system 308 comprises internal fluid flow lines in the formation testing tool 300. The conduit system 308 facilitates fluid communication within the formation testing tool 300. The conduit system 308 includes a plurality of valves 314, 316, 318, 320 and 322 to enable the selective directing of the formation fluid as it flows into and through the formation testing tool 300.

In FIG. 2, the conduit system 308 includes at least two paths or passages. A first passage leads from the probe assembly 306 through the formation testing tool 300 to an exit port 342. The first passage enables transferring of formation fluid directly to the borehole 340, such as during a clean-up operation. The second passage leads from the probe assembly 306 through the formation testing tool 300 to the at least one sample tank 310 of the formation testing tool 300.

In FIG. 2, the conduit system 308 also includes at least one pressure sensing device 324 (or 323), such as a pressure gauge or the like, disposed proximal the probe assembly 306. The pressure sensing device 324 enables monitoring of the formation pressure based on the pressure of the formation fluid entering the conduit system 308 from the formation 312. Valves 314, 318 are disposed in the conduit system 308 downstream of the pressure sensing device 324. When the valves 314, 318 are positioned in the closed position, pressure in the conduit system 308 between the probe 306 and valves 318, 314 is allowed to build up to the formation pressure. This positioning provides accurate measurements of the pressure of formation fluid entering the conduit system 308 from the formation 312. "Downstream" of the pressure sensing device is used herein to mean positioned in the conduit system 308 further away from the probe assembly 306 than the pressure sensing device 324.

In FIG. 2, the conduit system 308 also preferably includes a second pressure sensing device 323 disposed proximal the exit port 342 leading to the borehole 340. The second pressure sensing device 323 is positioned to enable monitoring of the pressure of borehole fluid in the borehole 340. While it is desirable to have more than one pressure gauge, any number of pressure gauges may be used to determine downhole sampling conditions. By having two or more pressure gauges, it is possible to simultaneously determine wellbore pressure ($P_H$) and formation pressure ($P_F$), and the pressure differential $P_H$ versus $P_F$.

At least one valve 314 is preferably disposed upstream of the pressure sensing device 323. When the valve 314 is positioned in the closed position, the pressure sensing device 323 can be used to obtain an accurate measurement of the pressure of the borehole fluid in the borehole 340. "Upstream" of the pressure sensing device 323 as used herein means positioned in the conduit system 308 further away from the exit port 342 than the pressure sensing device 323.

The sample tank 310 is arranged in fluid communication with the internal conduit system 308. The sample tank 310 is adapted to accept and retain an amount of formation fluid transferred thereto. As shown in FIG. 2, the sample tank 310 includes a first variable volume (hereafter referred to as the sample chamber 310A) and a second variable volume (hereafter referred to as the buffer chamber 310B). The sample chamber 310A and the buffer chamber 310B of the sample tank 310 are separated by a movable fluid separator 310C, such as a piston, disposed there between. The movement of the fluid separator 310C results in a change in the volume on the sample chamber 310A and the buffer chamber 310B of the sample tank 310.

The moveable fluid separator 310C may be a piston, diaphragm, or the like. in FIG. 2, the moveable fluid separator 310C is adapted to move along the interior of the sample tank 310 between a first position proximal an entrance port 313A on the sample chamber 310A of the sample tank 310 and a second position proximal an exit port 313B on the buffer chamber 310B of the sample tank 310. The sample tank 310 is arranged such that the sample chamber 310A is in fluid communication with the conduit system 308 and the buffer chamber 310B is in fluid communication with the borehole 340. Additionally, a valve could be positioned between the buffer chamber 310B and the exit port 313B. This would allow a sample to be overpressured before retrieval at surface.

In the example shown in FIG. 2, the formation testing tool 300 is lowered into the borehole 340 using a work string 330. Casing 338 is disposed in the borehole 340 and fixed in place using cement 336. The borehole 340 is filled with borehole fluid selected to have a hydrostatic pressure that is less than the formation pressure at the desired depth. The probe assembly 306 that extends from the formation testing tool 300 engages with the casing 338. Fluid communication is initiated between the formation testing tool 300 and the subsurface formation 312 by perforating or drilling a fluid channel 307 through the casing 338 and cement 336 to the formation 312. The tool 300 may optionally be provided with additional devices, such as perforation module 339, for creating fluid channels in the wellbore. Techniques and devices for creating fluid channels are described in U.S. Pat. No. 5,692,565 to MacDougall. As shown in FIG. 3A, valves 314, 316 can be opened to allow debris and contaminates to be washed from the formation 312 to the borehole 340 as fluid communication is initiated.

Referring to FIG. 2, the wellhead equipment 301 is applied to the borehole 340 and sealed using the sealing apparatus 328. The pressure increasing device 332 of the wellhead equipment 301 may be manipulated to increase the pressure of the borehole fluid in the borehole 340 to a selected pressure proximal to the formation pressure. For example, if the pressure increasing device 332 is a pump, additional borehole fluid is pumped into the borehole to increase the pressure of the borehole fluid. Alternatively, the borehole pressure may be increased by introducing a fluid or material into the borehole 340 which has a greater density than the borehole fluid. Because the formation pressure is greater than the borehole pressure, the difference between the formation pressure and the borehole pressure causes formation fluid to flow from the formation 312 into the formation testing tool 300.

Figure 3C:
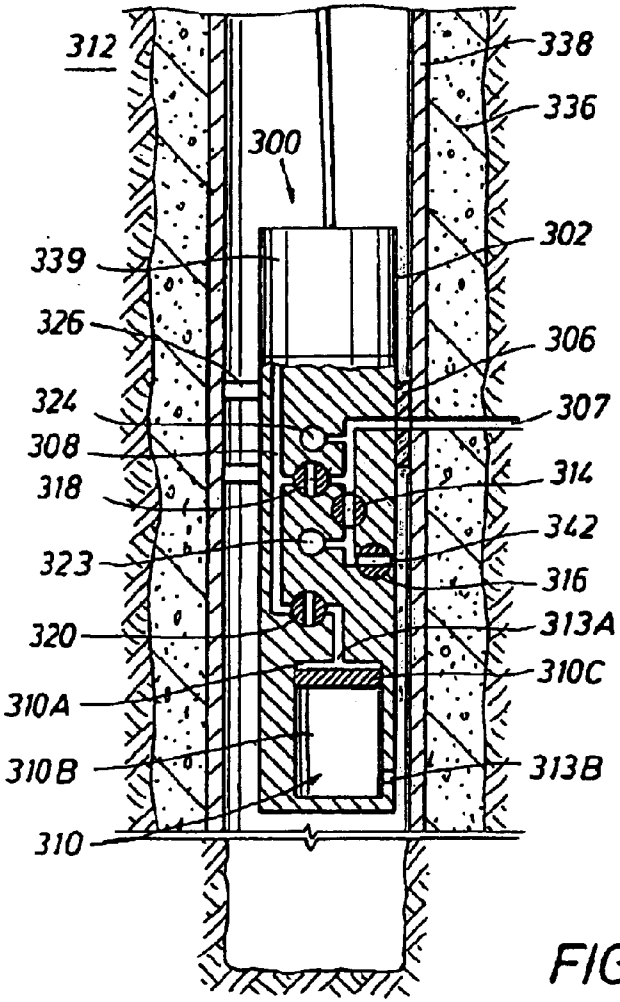
Figure 3B:
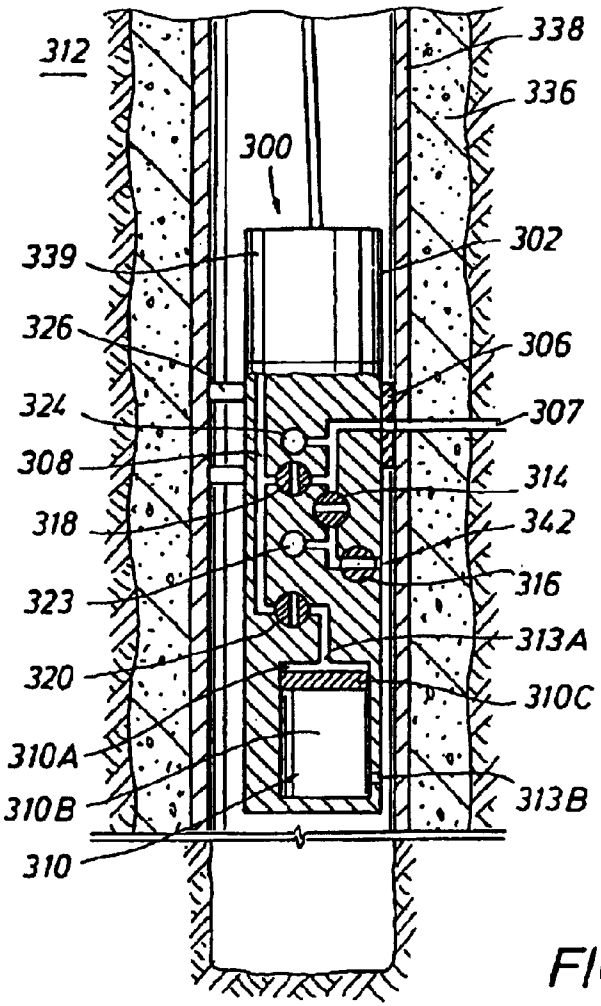

As shown in FIG. 3B, the pressure differential between the formation 312 and the borehole 340 may be monitored and adjusted to result in a desired drawdown of fluid from the formation 312 by closing the valve 314 between the probe 306 and borehole exit port 342, closing valve 318 and opening the valve 316 proximal to the exit port 342 to expose the first and the second pressure sensing devices 324, 323 to isolated formation pressure and borehole pressure, respectively.

A clean-up operation may be carried out prior to capturing a sample in at least one sample tank 310. For example, as shown in FIG. 3C, valves 314, 316 in the conduit system 308 between the probe assembly 306 and the borehole exit port 342 can be opened and the valve 318 closed to direct formation fluid from the formation to the borehole 340.

Figure 3E:
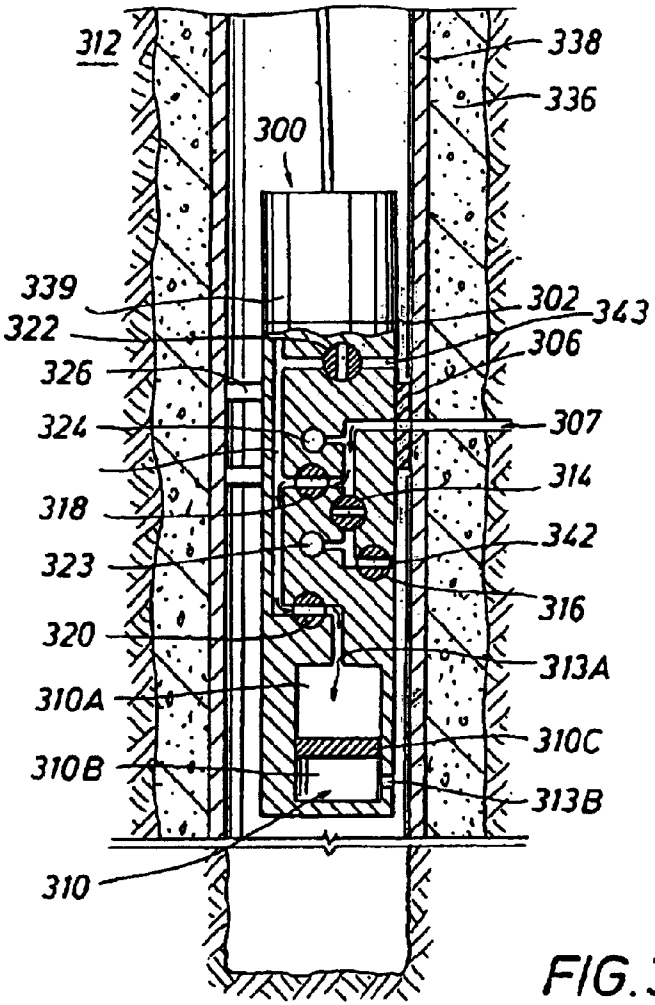
Figure 3D:
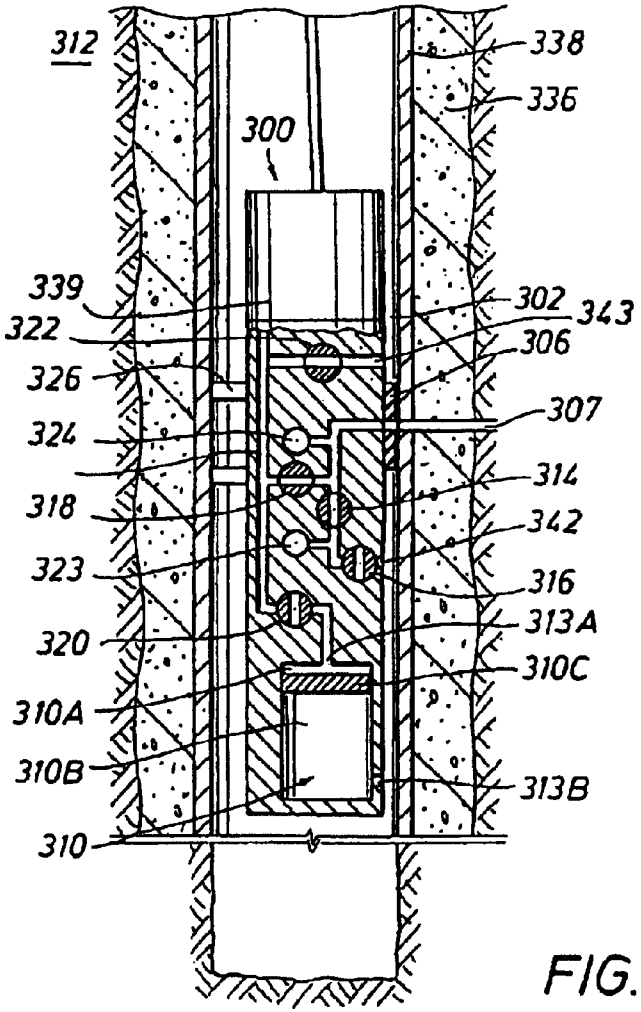

Alternatively, as shown in FIG. 3D, valves 314, 318, and 322 in the conduit system 308 between the probe assembly 306 and a borehole exit port 343 can be opened and the valves 316 and 320 closed to direct formation fluid to exit the formation testing tool 300 at a location above the point of sampling (alternatively, can also be below). A fluid analyzer (not shown) may be disposed in the path between the probe assembly 306 and a borehole exit port 343 to enable monitoring of the formation fluid as it flows from the formation 312. A sample tank 310 may also be disposed in the path between the probe assembly 306 and a borehole exit port 343 to enable a sample of formation fluid to be collected as it flows from the formation 312. Formation fluid may be directed to the borehole exit port 343 until the fluid analyzer (not shown) determines that the formation fluid flowing from the formation is substantially free of contaminants and debris.

As shown in FIG. 3E, for capturing a sample, a valve 320 is disposed proximal the entrance port 313A on the sample chamber 310A of the sample tank 310. The valve 320 enables selective transfer and/or capture of fluid from the conduit system 308 to the sample tank 310. For example, the sample tank 310 is configured such that when valves 318 and 320 are opened and 322 is closed, and the valves 314 and/or 316 are closed, the higher pressure formation fluid from the formation 312 is directed into the sample chamber 310A of the sample tank 310.

While FIGS. 2 and 3A–3E depict a preferred arrangement of valves, gauges and conduits, it will be appreciated by one of skill in the art that the arrangement may be varied. For example, valves 318, 314 and/or pressure gauges 323, 324 may be repositioned along conduit 308 closer to probe assembly 306. Other variations may also be envisioned.

The difference between the formation pressure and the borehole pressure results in the flow of formation fluid into the sample tank 310. This results in the displacement of the movable fluid separator 310C in a direction toward the exit port 313B and expansion of the volume of the sample chamber 310A of the sample tank 310. As the moveable fluid separator 310C is displaced, the volume of the buffer chamber 310B of the sample tank 310 decreases and the moveable fluid separator 310C forces the lower pressure fluid of the buffer chamber 310B of the sample tank 310 out of the exit port 313B and into the borehole 340.

Formation fluid may continue to flow through the conduit system 308 and into the sample tank 310 until the moveable fluid separator 310C comes to rest against a surface on the buffer chamber 310B of the sample tank 310. After the moveable fluid separator 310C comes to rest against the surface on the buffer chamber 310B of the sample tank 310, the pressure of the formation fluid on the sample chamber 310A of the sample tank 310 may be allowed to increase until it equalizes the pressure of the formation fluid entering the conduit system 308. Once formation fluid has been captured in the sample tank 310, the valve 320 may be closed to retain the captured formation fluid sample in the sample tank 310. The sample pressure can then be increased by increasing the borehole pressure to a desired level. The port 313B may be provided with an exit port valve that may be closed to trap and/or isolate the sample tank 310.

Referring to FIG. 2, once a formation sample has been captured in the formation testing tool as described above, the communication path from the formation testing tool 300 to the formation 312 may be plugged using the perforation module 339 as described in U.S. Pat. No. 5,692,565 to MacDougall. The formation testing tool 300 is then disengaged from the borehole 340 and moved to another location to perform additional sampling operations or retrieved at the surface.

Those skilled in the art will appreciate that embodiments of the present invention may be carried out under manual control or automatic control from the surface. For example, a pressure increasing device 332 included in the wellhead equipment 301 may be controlled manually by an operator monitoring the downhole pressure differential between the borehole and the formation, which may be transmitted to the surface by any method known in the art. The pressure increasing device 332 may be manipulated automatically using a controller (333) which based on downhole pressure readings and selected conditions automatically adjusts the pressure of the fluid in tile borehole to maintain it within a selected range.

The wellhead equipment, advantageously, allows for manipulation, regulation, and/or control of pressure in the borehole at the depth of the sampling operation. In other embodiments, wellhead equipment may include additional equipment known in the art for controlling and adjusting borehole pressure during testing or sampling operations. The additional equipment required for specific embodiments of the invention may be determined by one of ordinary skill in the art without undue research or experimentation.

Those skilled in the art will appreciate that existing formation testing tools may be modified and used in accordance with an embodiment of the invention based on the above description. The aforementioned modifications can be determined by one of ordinary skill in the art without undue research or experimentation.

While embodiments of the invention may be carried out using any formation testing tool known in the art, preferred formation testing tools and techniques may include such sampling tools as those disclosed in U.S. Pat. No. 5,692,565 to MacDougall, U.S. Pat. No. 4,860,581 to Zimmerman and/or U.S. Pat. No. 4,929,139 to Zimmerman, all of which are assigned to Schlumberger Technology Corporation, the assignee of the present invention.

In another aspect, the present invention provides a method for sampling a subsurface formation without requiring a downhole pump. An exemplary embodiment in accordance with this aspect of the invention is illustrated in FIG. 4.

Figure 4:
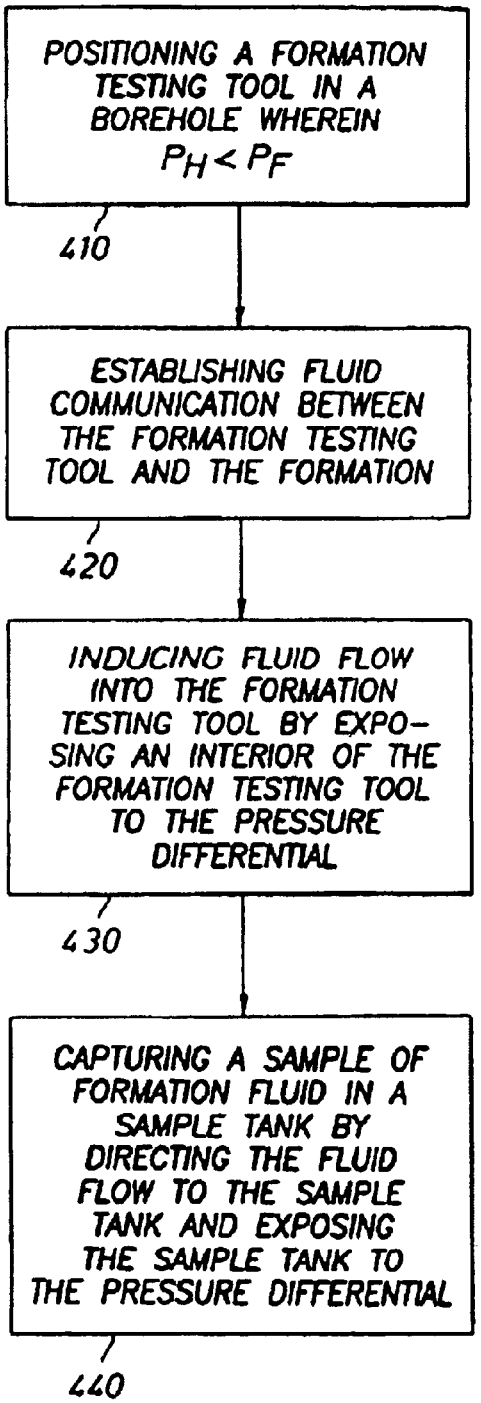
FIG. 4 shows a method for obtaining a formation fluid sample from a subsurface formation in accordance with the present invention.

In the method of FIG. 4, a formation testing tool is positioned in a borehole having borehole fluid therein such that the borehole pressure ($P_H$) is less than the formation pressure ($P_F$) at the desired depth for sampling. Fluid communication is established between the formation testing tool and the subsurface formation 420 and flow is induced into the formation testing tool by exposing an interior of the formation testing tool to the pressure differential between the formation and the borehole 430. A sample of the formation fluid is captured in at least one sample tank by directing the formation fluid to the sample tank and exposing the sample tank to the pressure differential 440.

Figure 5:
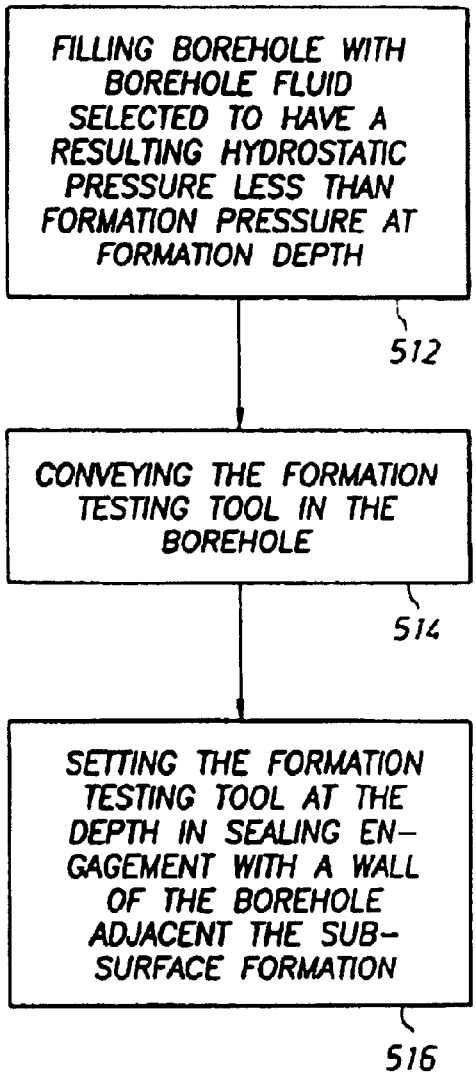
FIG. 5 shows an example of steps for positioning a formation testing tool.

As shown in FIG. 5, in one example, positioning of the formation testing tool includes filling the borehole with a borehole fluid selected to have a hydrostatic pressure that is less than the formation pressure at the desired depth 512. The formation testing tool is then conveyed in the borehole 514 and set at the formation depth in sealing engagement with a wall of the borehole and adjacent to the subsurface formation 516. The formation testing tool may be conveyed in the borehole by any method known in the art. For example, the formation testing tool may be conveyed by attaching the formation testing tool to a wireline cable, drill string, coiled tubing, jointed tubing, or other known work string. Setting the formation testing tool may include engaging a probe assembly of the formation testing tool with the borehole wall. Setting the formation testing tool may also include engaging stabilizing pads with an opposite side of the wellbore to stabilize the formation testing tool in the wellbore.

Once the formation testing tool is positioned in the borehole (410 in FIG. 4), fluid communication between the formation testing tool and the subsurface formation is established (420 in FIG. 4). Establishing fluid communication between the formation testing tool and the subsurface formation may include establishing a fluid channel through the wall of the borehole between a probe assembly in sealing engagement with the borehole wall and the subsurface formation to be sampled. In a cased borehole, establishing fluid communication may comprise drilling or perforating through casing and cement disposed in the borehole.

Figure 6:
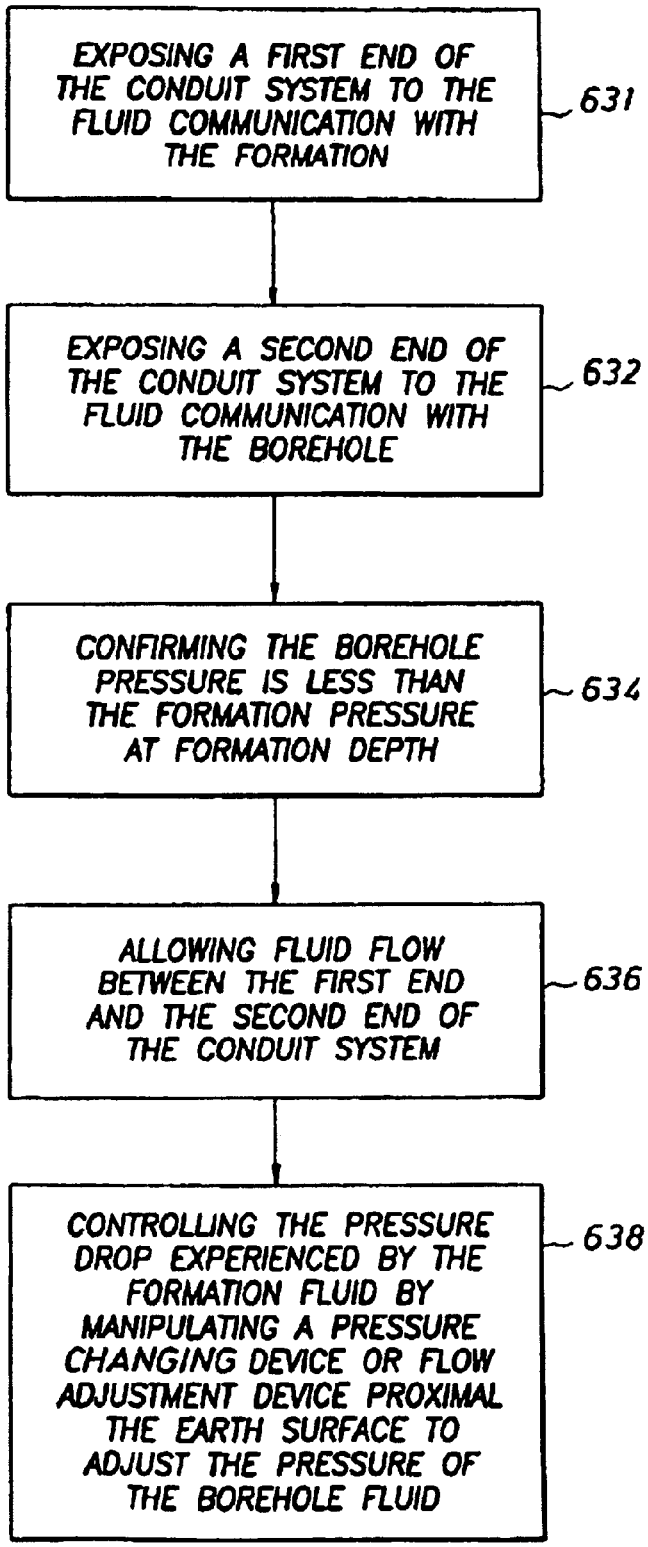
FIG. 6 shows an example of steps for inducing fluid flow from a subsurface formation into a formation testing tool.

Referring to FIG. 4, once fluid communication between the formation testing tool and the formation is established 420, flow from the formation is induced 430. As shown in FIG. 6, in one example, inducing flow comprises exposing a first end of a conduit system in the formation testing tool to the fluid communication established between the formation testing tool and the subsurface formation 631 and exposing a second end of the conduit system to the fluid communication with the borehole 632.

As shown in FIG. 6, inducing flow also comprises confirming that the borehole pressure is less than the formation pressure at (or proximal) the desired depth 634 and allowing fluid to flow between the first end and the second end of the conduit system 636. The pressure drop experienced by the formation fluid may be controlled by manipulating a pressure changing device or a flow adjustment device at the surface to adjust the pressure of the borehole fluid 638.

Figure 7:
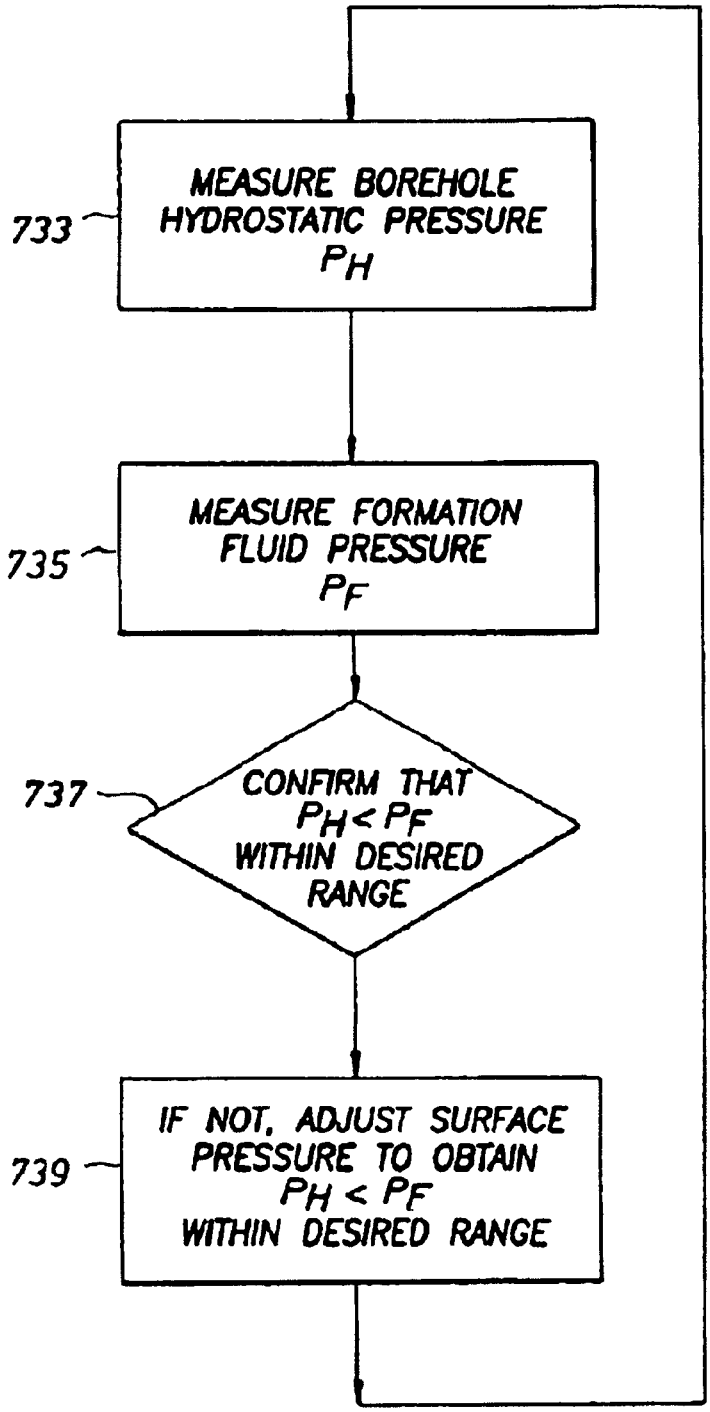
FIG. 7 shows an example of steps for monitoring and controlling the pressure differential experienced by the formation fluid during a clean up and/or sample capturing operation.

As shown in FIG. 7, in one example, confirming the borehole pressure is less than the formation pressure (634 in FIG. 6) comprises measuring the borehole pressure 733, measuring the formation pressure 735, and comparing the borehole pressure measurement ($P_H$) and the formation pressure measurement ($P_F$) 737 to determine if the underbalanced pressure situation is within a desired range for cleanup and/or sampling. The borehole pressure is preferably measured proximal to the desired depth to obtain an accurate assessment of whether the desired underbalanced situation exists at the depth of investigation. If a desired underbalanced pressure situation does not exist, the surface pressure of the borehole fluid may be adjusted 739 and the effect on the borehole pressure at the desired depth monitored downhole until the desired underbalanced pressure situation is established. In a preferred embodiment, the borehole pressure is adjusted to maintain the pressure differential between the borehole and the formation to within a selected range to maintain the desired fluid sample in the single phase.

Figure 8:
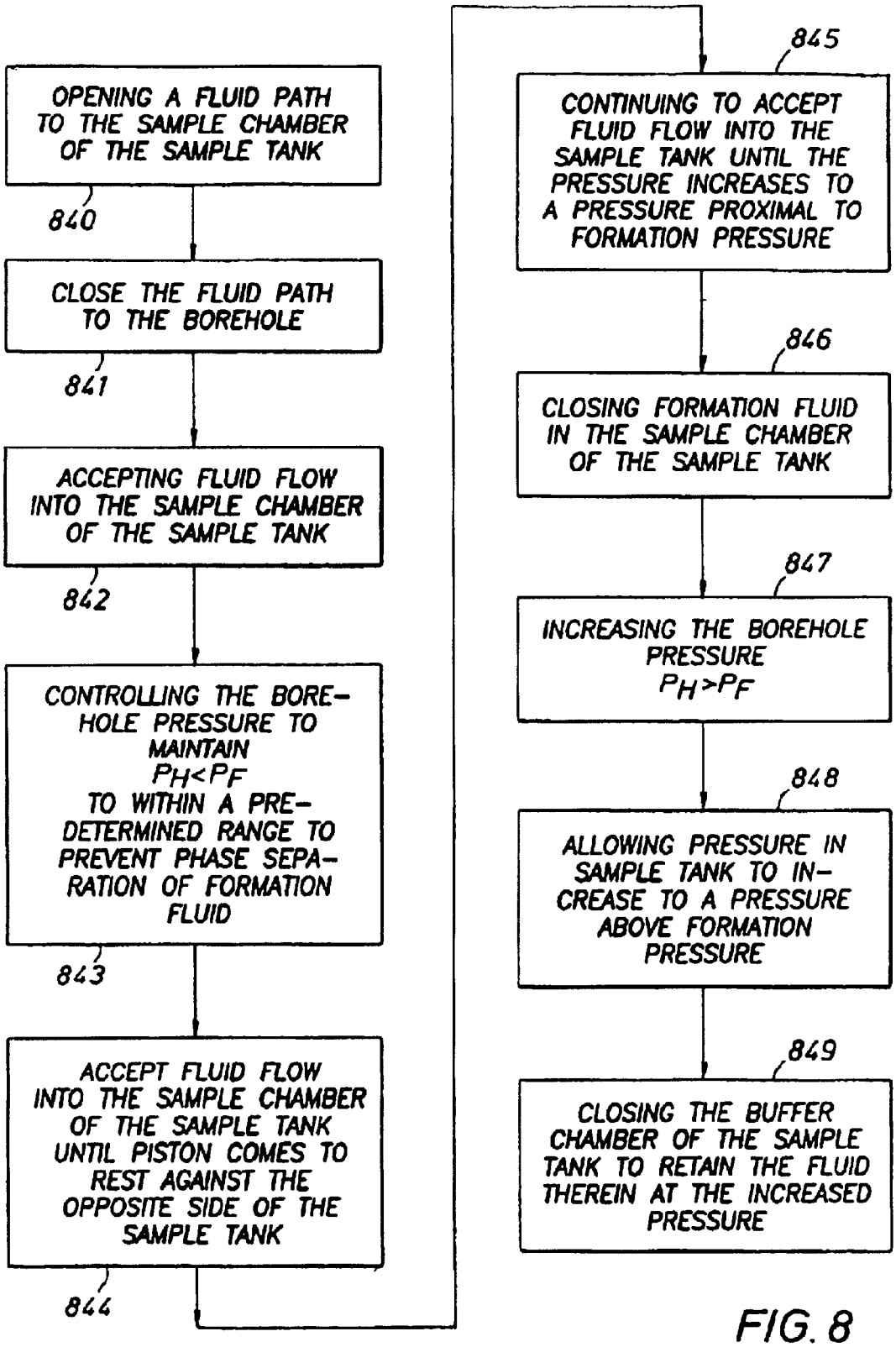
FIG. 8 shows an example of steps for capturing a formation fluid sample.

After fluid flow is induced, the formation fluid is captured in at least one sample tank. As shown in FIG. 8, capturing a formation fluid sample (440 in FIG. 4) may comprise opening a flow path to a sample chamber of the sample tank 840, closing a flow path directing formation fluid to the borehole 841, and accepting formation fluid into a sample chamber of the sample tank 842. The borehole fluid pressure is controlled using wellhead equipment to maintain a pressure differential between the borehole and the formation. The pressure differential is preferably kept to within a selected range to prevent phase separation of the formation fluid as it is transferred to and captured in the sample tank 843.

Flow is accepted into the sample chamber of the sample tank until a moveable fluid separator comes to rest 844. The moveable fluid separator comes to rest. The moveable fluid separator may seat or seal against the exit port leading out of the sample tank and into the borehole. Alternatively, the moveable fluid separator may be adapted to come to rest after collection of a selected volume of formation fluid.

Formation fluid is allowed to enter into the sample chamber of the sample tank until the pressure in the sample tank increases to a pressure proximal to formation pressure 845. Formation fluid may enter the sample tank until the pressure in the sample tank substantially equals the formation pressure. The sample tank is then closed to retain the formation fluid therein 846.

In some cases, overpressurizing a formation fluid sample may be desired to ensure that the captured sample is maintained in the single phase upon cooling when it is retrieved at the surface. In these cases, after closing the formation fluid in the sample chamber of the sample tank 846, the borehole pressure is adjusted to a pressure higher than the formation pressure 847. By exposing the sample tank to the adjusted higher borehole pressure, the formation fluid in the sample tank may be increased to a desired pressure above the formation pressure 848. The pressure in the sample tank may be monitored by a pressure sensing device disposed in or proximal the sample tank, or by a pressure sensing device in communication with the borehole at the desired depth.

Once the desired sample pressure is achieved, the buffer chamber of the sample tank can be closed to capture the formation fluid sample at the higher pressure 849.

In another aspect, the present invention may also provide a method for performing a controlled formation test, such as a pretest, without requiring a downhole pump to control the drawdown rate of the formation fluid during the formation test. Embodiments in accordance with this aspect of the invention will be apparent to those of ordinary skill in the art in view of the above description.

The method may also comprise positioning a formation testing tool in a borehole having borehole fluid therein with a pressure less than the formation pressure such that a pressure differential exists there between. The formation testing tool includes at least one sample tank having two variable volumes therein on a sample chamber and a buffer chamber of the sample tank. The sample tank includes a moveable fluid separator disposed between the volumes. The movement of the moveable fluid separator results in a change in the volume on the sample chamber and the buffer chamber of the sample tank.

The method may further comprise establishing fluid communication between the formation testing tool and the formation and inducing movement of formation fluid from the formation into the formation testing tool by exposing an interior of the formation testing tool to the pressure differential. The method may also comprise drawing down a volume of formation fluid into the sample chamber of the sample tank by directing the formation fluid to the sample chamber and exposing the buffer chamber of the sample tank to the lower borehole pressure. The pressure differential across the moveable fluid separator in the sample tank, advantageously, results in the drawdown of formation fluid into the sample tank. The method may further comprise holding the volume on the sample chamber of the sample tank constant and allowing the pressure in the sample tank to build up to a pressure proximal the formation pressure.

In accordance with one or more embodiments of the invention, the borehole may be an open borehole that includes a mudcake build-up along the borehole wall to reduce the likelihood of the formation fluid flowing directly from the formation into the borehole during the sampling operation. In a preferred embodiment, the borehole may comprise casing and cement along the borehole wall to reduce or eliminate the likelihood of the formation producing fluid into the underbalanced borehole during the sampling operation. In one or more embodiments, the well may be shut-in at the surface after the formation testing tool is run into the borehole, and the surface pressure applied to the borehole fluid may be reduced to zero using wellhead equipment to ensure that the initial borehole pressure at the desired depth is lower than the pressure of the formation being sampled.

The borehole pressure may also be monitored and adjusted at any desired time during a sampling or testing operation. The borehole pressure may be monitored and adjusted during the initial inducement of flow into the formation testing tool, during a clean-up operation, and/or during the sample capturing operation. The flow (or pressure) may be monitored and adjusted to remain within a selected range so that a desired drawdown of formation fluid can be achieved. For example, based on monitored formation pressure measurements, a desired borehole pressure may be determined. Additionally, the surface pressure applied to the borehole fluid may be adjusted to produce the desired borehole pressure at the desired depth. Preferably, the borehole pressure is monitored and selectively adjusted to maintain a selected pressure differential that results in a formation fluid pressure drop that is as large as possible without crossing the bubble point pressure or the asphaltene onset pressure. By monitoring and controlling the pressure differential between the formation pressure and the borehole pressure to within a predetermined range, a formation fluid sample obtained in a single phase as it is collected by the formation testing tool.

The borehole fluid may also be selected to have a density that results in a desired hydrostatic pressure in the borehole that is less than the expected or known formation pressure at the desired depth. Examples of fluids that may be used to create an underbalanced pressure situation in a borehole include lighter density fluids, such as diesel based, water based, or oil based fluids. However, those skilled in the art will appreciate that any other type of fluid that results in an underbalanced pressure situation in the borehole may be used as the borehole fluid without departing from the spirit of the invention.

The fluid channel may also be established by penetrating, drilling, or perforating a tunnel between the formation testing tool and the subsurface formation. One example of a method known in the art that may be used to establish fluid communication between a formation testing tool and a subsurface formation in a cased borehole is described in detail in U.S. Pat. No. 5,692,565 to MacDougall et al., assigned to the assignee of the present invention. Those skilled in the art will appreciate that any method known in the art for establishing fluid communication between a formation testing tool and a subsurface formation may be adapted and used for other embodiments without departing from the spirit of the invention.

The moveable fluid separator in the sample tank may also be an expandable separator which separates a volume of fluid on the sample chamber of the sample tank from a volume of fluid on the buffer chamber of the sample tank. The moveable fluid separator between the sample chamber and the buffer chamber of the sample tank preferably maintains the separation of formation fluid entering the sample tank from the borehole fluid on the backside of the moveable fluid separator while allowing the pressure differential between the formation and the borehole to result in a drawdown of formation fluid into the sample tank.

A clean-up operation may also be performed prior to the capturing of a sample in the formation testing tool. The clean-up operation may comprise passing formation fluid from the formation testing tool to the borehole while analyzing the formation fluid for contaminates until the formation fluid is determined to be substantially free of contaminants (i.e., is detected to contain less than or equal to a selected amount of contaminates). The formation fluid may be analyzed using any method known in the art, including resistivity and optical analyzing methods.

The devices and methods described above may provide several advantages. For example, one or more embodiments may provide a method that advantageously provides the ability to manipulate borehole pressure after the actual formation pressure has been measured. This may allow for accurate control of the pressure drop experienced by the formation fluid during a sampling operation while eliminating concerns about downhole pump failure problems. In one ore more embodiments, by manipulating the borehole pressure from the surface, the drawdown pressure, and/or the flow rate of the formation fluid can be easily controlled and adjusted and conversion between an underbalanced and an overbalanced pressure situation can be easily achieved. In one or more embodiments, because the sampling operation is a stationary operation, it may be easy to establish a static seal on the work string using wellhead pressure gear.

Other advantages may include that establishing fluid communication between the formation testing tool and the subsurface formation can be done in an entirely underbalanced pressure situation, thereby, minimizing damage to the formation during this operation. In one or more embodiments, the borehole pressure may advantageously be adjusted to substantially equal the formation pressure, and then the drawdown rate of the formation fluid may be accurately adjusted from the surface to obtain a formation fluid sample in a single phase with a minimal pressure drop across the formation fluid as it is captured. Advantageously, techniques in accordance with the invention may be used to perform controlled pretests using large volume chambers.

Those skilled in the art will appreciate that although various techniques have been shown herein as used in a cased borehole environment the invention is not limited to cased boreholes. Rather, embodiments of the invention may be used for any type of borehole including openhole, cased, or lined boreholes, without departing from the spirit of the invention. For example, in an alternative embodiment, a method or apparatus in accordance with the invention may be used in an openhole well having a specialized mudcake disposed on the wellbore walls to reduce the possibility of the formation fluid producing into the wellbore during the underbalanced sampling operation.

While the invention has been described with respect to a limited number of embodiments, those skilled in the art, having benefit of this disclosure, will appreciate that other embodiments can be devised which do not depart from the scope of the invention as disclosed herein. For example, embodiments of the invention may be easily adapted and used to perform specific formation sampling or testing operations without departing from the spirit of the invention. Accordingly, the scope of the invention should be limited only by the attached claims.

What is claimed is:

1. A method for obtaining a formation fluid sample from a subsurface formation traversed by a borehole, the method comprising:

positioning a formation testing tool in the borehole containing borehole fluid with a pressure less than formation pressure such that a pressure differential exists there between, the formation testing tool including a sample tank having a sample chamber, a buffer chamber, and a movable fluid separator disposed there between;

establishing fluid communication between the formation testing tool and the formation;

inducing movement of the formation fluid into the formation testing tool by exposing an interior of the formation testing tool to the pressure differential; and capturing a sample of the formation fluid in the sample tank by exposing the sample tank to the pressure differential.

2. The method of claim 1, wherein the capturing comprises directing the formation fluid to the sample chamber of the sample tank and exposing the buffer chamber of the sample tank to the borehole pressure.

3. The method of claim 1, wherein the positioning comprises:

conveying the formation testing tool in the borehole; and setting the formation testing tool in sealing engagement with a wall of the borehole adjacent the subsurface formation.

4. The method of claim 3, wherein the setting the formation testing tool comprises engaging a probe assembly with the borehole wall.

5. The method of claim 4, wherein the establishing fluid communication comprises establishing a fluid channel through the wall of the borehole between the probe assembly and the subsurface formation.

6. The method of claim 3, wherein the borehole wall comprises casing and cement.

7. The method of claim 6, wherein the establishing fluid communication comprises drilling a fluid channel between the formation testing tool and the subsurface formation through the casing and cement.

8. The method of claim 6, wherein the establishing the fluid channel comprises perforating a fluid channel between the formation testing tool and the subsurface formation through the casing and cement.

9. The method of claim 1, wherein the formation testing tool further comprises a conduit system disposed therein adapted to direct fluid flow through the formation testing tool, and the inducing movement of formation fluid comprises:

exposing a first end of the conduit system to the fluid communication with the formation; and exposing a second end of the conduit system to fluid communication with the borehole.

10. The method of claim 9, wherein the inducing movement of formation fluid further comprises:

confirming the borehole pressure is less than the formation pressure at depth; and allowing fluid flow between the first end and the second end of the conduit system.

11. The method of claim 10, wherein the confirming comprises:

measuring the borehole pressure proximal to formation depth;

measuring the formation pressure; and comparing the borehole pressure and the formation pressure measurements.

12. The method of claim 11, wherein confirming further comprises adjusting the borehole pressure such that the pressure differential is within a selected range.

13. The method of claim 11, wherein the measuring the borehole pressure comprises exposing a pressure sensing device proximal the second end of the conduit system to the fluid communication with the borehole.

14. The method of claim 11, wherein the measuring the formation pressure comprises exposing a pressure sensing device proximal the first end of the conduit system to the fluid communication with the formation.

15. The method of claim 1, wherein inducing movement comprises manipulating the borehole pressure to control the pressure differential to within a predetermined range to prevent phase separation of the formation fluid during sampling.

16. The method of claim 1, wherein inducing movement further comprises:

controlling a pressure drop experienced by the formation fluid by manipulating at least one of a flow adjustment mechanisms and a pressure increasing device disposed proximal an earth surface to adjust the pressure of the borehole fluid.

17. The method of claim 16, wherein borehole pressure is adjusted to substantially equal formation pressure and the flow rate of formation fluid into the formation tool is adjusted from the surface by selectively adjusting the borehole pressure.

18. The method of claim 16, wherein borehole pressure is adjusted to substantially equal formation pressure and the flow rate of formation fluid into the formation tool is adjusted from the surface by selectively adjusting the flowrate from the borehole at surface via a metering valve.

19. The method of claim 16, wherein the flow adjustment mechanism comprises a valve.

20. The method of claim 16, wherein the pressure increasing device comprises a pump.

21. The method of claim 16, wherein the borehole pressure is adjusted to a selected pressure so that the pressure drop experienced by the formation fluid is as large as possible without crossing at least one selected from the bubble point pressure and the asphaltene onset pressure to maintain the formation fluid in single phase as it moves into the formation testing tool.

22. The method of claim 1, wherein prior to the capturing, formation fluid is analyzed for contaminates as it flows into the formation testing tool and is directed to the borehole until the formation fluid is determined to contain an acceptable amount of contaminates therein.

23. The method of claim 1, wherein the directing the formation fluid to the sample tank comprises:

opening the sample chamber of the sample tank; and closing an exit path in the formation testing tool to the borehole.

24. The method of claim 1, wherein the capturing further comprises accepting fluid flow into the sample chamber of the sample tank until said sample tank is substantially filled with formation fluid.

25. The method of claim 24, wherein the capturing further comprises accepting fluid flow into the sample chamber of the sample tank until the pressure in the sample tank increases to a pressure above the borehole pressure.

26. The method of claim 1, wherein the capturing further comprises monitoring and controlling the pressure differential between the formation pressure and the borehole pressure to within a predetermined range to prevent phase separation of the formation fluid during sampling.

27. The method of claim 1, wherein the capturing further comprises:

sealing the formation fluid in the sample chamber of the sample tank;

increasing the borehole pressure by manipulating the at least one pressure increasing device;

allowing the pressure of the formation fluid in the sample tank to increase to a pressure above the formation pressure; and sealing in the buffer chamber of the sample tank to retain the formation fluid sample at the increased pressure.

28. The method of claim 1, wherein the moveable fluid separator comprises a free floating piston.

29. A method for performing a pretest, comprising:

positioning a formation testing tool in a borehole having borehole fluid therein with hydrostatic pressure less than formation pressure such that a pressure differential exists there between, the formation testing tool including a variable volume sample tank having a sample chamber, a buffer chamber, and a movable fluid separator disposed there between;

establishing fluid communication between the formation testing tool and the formation;

inducing movement of formation fluid from the formation into the formation testing tool by exposing an interior of the formation tool to the pressure differential;

drawing a volume of the formation fluid in the sample tank by directing the formation fluid to the sample chamber of the sample tank and exposing the buffer chamber of the sample tank to the borehole pressure, the pressure differential between the borehole and the formation pressure resulting in a drawdown of formation fluid from the formation into the sample tank; and holding the volume of the sampling chamber constant to allow pressure in the sampling chamber to build up to a pressure proximal to the formation pressure.

30. The method of claim 29, wherein the casing and cement are disposed in the wellbore, and the establishing fluid communication comprises establishing a fluid channel between the formation testing tool and the subsurface formation through the casing and cement.

31. The method of claim 29, wherein the formation testing tool further comprises a conduit system disposed therein to direct fluid flow therethrough, and the inducing movement of formation fluid comprises:

exposing a first end of the conduit system to the fluid communication with the formation;

exposing a second end of the conduit system to fluid communication with the borehole;

confirming the borehole pressure is less than the formation pressure at depth; and allowing fluid flow between the first end and the second end of the conduit system.

32. The method of claim 29, wherein the inducing movement further comprises controlling a pressure drop experienced by the formation fluid by manipulating at least one of a flow adjustment mechanism and a pressure increasing device disposed proximal an earth surface to adjust the pressure of the borehole fluid.

33. The method of claim 32, wherein the borehole pressure is adjusted to a selected pressure so that the pressure drop experienced by the formation fluid is as large as possible without crossing at least one selected from the bubble point pressure and the asphaltene onset pressure to maintain the formation fluid in single phase as it moves into the formation testing tool.

34. The method of claim 29, wherein prior to the capturing, formation fluid is analyzed for contaminates as it flows into the formation testing tool and is directed to the borehole until the formation fluid is determined to contain less than an acceptable amount of contaminates therein.

35. The method of claim 29, wherein the capturing further comprises monitoring and controlling the pressure differential between the formation pressure and the borehole pressure to within a predetermined range to prevent phase separation of the formation fluid during sampling.

36. The method of claim 29, wherein inducing movement comprises manipulating the borehole pressure to control the pressure differential between the formation pressure and the borehole pressure to within a predetermined range to prevent phase separation of the formation fluid during sampling.

37. The method of claim 29, wherein inducing formation fluid flow comprises: regulating the pressure drop experienced by the formation fluid by manipulating the pressure of the borehole fluid using wellhead equipment at earth surface;

transferring formation fluid from the formation into a sample tank by controlling the pressure differential between the formation pressure and the borehole pressure to within a predetermined range to prevent phase separation of the formation fluid during sampling.

38. The method of claim 29, wherein the inducing movement further comprises controlling a pressure drop experienced by the formation fluid by manipulating at least one of a flow adjustment mechanism and a pressure increasing device disposed proximal an earth surface to adjust the flow rate of the borehole fluid.

39. A sampling system for obtaining a formation fluid sample from a subsurface formation traversed by a borehole, the system comprising:

formation testing tool adapted for placement in the borehole and including:

a probe assembly adapted to establish fluid communication between the formation testing tool and the subsurface formation;

at least one sample tank having a sample chamber adapted to accept formation fluid therein, a buffer chamber in fluid communication with the borehole, and a fluid separator disposed there between to maintain separation of fluid in the sample chamber and the buffer chamber of the sample tank;

a conduit system adapted to direct fluid flow through the formation testing tool, the conduit system having a first end in fluid communication with the probe assembly, a second end in fluid communication with the borehole, and a third end in fluid communication with the sample chamber of the sample tank; and a wellhead disposed about the borehole proximal the surface and adapted to seal borehole fluid therein such that the borehole fluid is maintained at a desired pressure.

40. The sampling system of claim 39, wherein the wellhead comprises at least one pressure increasing device disposed in fluid communication with the borehole and adapted to enable selective increase of borehole fluid pressure in the borehole.

41. The sampling system of claim 40, wherein the wellhead farther comprises at least one flow adjustment device adapted to enable adjustment of borehole fluid flow out of the borehole.

42. The sampling system of claim 41, wherein the at least one flow adjustment device comprises a metering valve adapted to enable selective removal of borehole fluid from the borehole to decrease a hydrostatic pressure therein.

43. The sampling system of claim 42, wherein the wellhead equipment enables selective control to within a predetermined range to prevent phase separation of formation fluid during the sampling.

44. The sampling system of claim 41, further comprising a controller operationally coupled to the at least one pressure increasing device and the at least one flow adjustment device and adapted to automatically control fluid flow in and out of the borehole based on differential pressure measured downhole between the formation pressure and the borehole pressure during sampling.

45. The sampling system of claim 40, wherein the at least one pressure increasing device comprises a pump adapted to pump borehole fluid into the borehole to increase a hydrostatic pressure therein.

46. The sampling system of claim 39, wherein the internal conduit system comprises:

a first path between the probe assembly and the borehole to enable fluid communication between the probe and the borehole; and a second path between the probe and the sample tank to enable fluid communication between the probe and the sample tank.

47. The sampling system of claim 39, wherein the internal conduit system further comprises at least one flow restriction device disposed in the first path to enable selective fluid communication therethrough.

48. The sampling system of claim 39, wherein the internal conduit system further comprises at least one flow restriction device disposed in the second path to enable selective fluid communication therethrough.

49. The sampling system of claim 39, wherein a pressure sensing device is disposed in the conduit system proximal the first end to enable a monitoring of formation pressure.

50. The sampling system of claim 39, wherein a pressure sensing device is disposed proximal the first end of the conduit system between the probe and at least one flow restriction device to enable selective isolation and measurement of formation pressure.

51. The sampling system of claim 39, wherein the second end of the conduit system is coupled to an exit port in the formation testing tool leading to the borehole and a flow restriction device is disposed in the conduit system proximal the exit port to enable selective fluid communication between the conduit system and the borehole.

52. The sampling system of claim 39, wherein a pressure sensing device is disposed proximal the second end of the conduit system to enable a monitoring of borehole pressure.

53. The sampling system of claim 39, wherein a pressure sensing device is disposed proximal the second end of the conduit system between at least one flow restriction device and a port to the borehole to enable selective isolation and measurement of borehole pressure.

54. The sampling system of claim 39, wherein the third end of the conduit system is coupled to an opening in the at least one sample tank and a valve is disposed in the conduit proximal the opening to enable selective fluid communication between the conduit system and the at least one sample tank.

55. The sampling system of claim 39, wherein a pressure sensing device is disposed proximal the sample tank and adapted to enable a monitoring of pressure in the sample tank.

56. The sampling system of claim 39, wherein the movable fluid separator comprises a free floating piston.

57. The sampling system of claim 39, wherein the wellhead equipment is arranged to enable surface manipulation of borehole pressure for selectively control of a pressure differential between formation pressure and the borehole pressure during sampling.

* * * * *